US008243008B2

(12) United States Patent
Nishinosono

(10) Patent No.: US 8,243,008 B2
(45) Date of Patent: Aug. 14, 2012

(54) SEPARATELY EXCITED INVERTER CIRCUIT AND LIQUID CRYSTAL DISPLAY TELEVISION

(75) Inventor: Kazuo Nishinosono, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 1143 days.

(21) Appl. No.: 12/150,357

(22) Filed: Apr. 28, 2008

(65) Prior Publication Data

US 2008/0273026 A1 Nov. 6, 2008

(30) Foreign Application Priority Data

May 1, 2007 (JP) ..... 2007-120706

(51) Int. Cl.
*G09G 3/36* (2006.01)

(52) U.S. Cl. ..... 345/102; 315/312

(58) Field of Classification Search ..... 345/102; 315/312

See application file for complete search history.

(56) References Cited

U.S. PATENT DOCUMENTS

| | | | | |
|---|---|---|---|---|
| 5,384,518 | A * | 1/1995 | Kido et al. | 315/225 |
| 5,736,973 | A * | 4/1998 | Godfrey et al. | 345/102 |
| 5,818,669 | A * | 10/1998 | Mader | 361/18 |
| 2003/0214773 | A1* | 11/2003 | Kitagawa | 361/118 |
| 2003/0222601 | A1* | 12/2003 | Yamamoto et al. | 315/291 |
| 2005/0275031 | A1* | 12/2005 | Dournelle et al. | 257/355 |
| 2006/0077000 | A1* | 4/2006 | Goudo | 327/434 |
| 2006/0181227 | A1* | 8/2006 | Lu | 315/312 |
| 2008/0054816 | A1* | 3/2008 | Shackle et al. | 315/209 R |
| 2008/0205093 | A1* | 8/2008 | Davies et al. | 363/35 |

FOREIGN PATENT DOCUMENTS

| | | |
|---|---|---|
| JP | 05-299990 | 11/1993 |
| JP | 2002-353795 | 12/2002 |
| JP | 07-013128 | 6/2003 |
| JP | 2003-179472 | 6/2003 |

* cited by examiner

*Primary Examiner* — Alexander Eisen
*Assistant Examiner* — Viet Pham
(74) *Attorney, Agent, or Firm* — Yokoi & Co., U.S.A., Inc.; Toshiyuki Yokoi

(57) ABSTRACT

The present invention discloses a separately excited inverter circuit whose switching circuit having a plurality of switching elements and which is capable of minimizing the damage of other switching elements even if any of the plurality of switching elements is short circuited and damaged. The separately excited inverter circuit includes: a switching circuit of which a full bridge circuit applies an AC voltage to the primary winding of the step-up transformer 26*e*; a control circuit C1 for performing the switching control of a switching circuit 26*b* when receiving a command signal for commanding the control circuit to oscillate from a transmission line for transmitting the command signal for commanding it to start and stop oscillation; terminal voltage monitoring circuits 51 and 52 for monitoring a terminal voltage across a gate of MOSFET forming the switching circuit 26*b* and outputting a reference voltage when the gate voltage exceeds a predetermined threshold; and a thyristor circuit 53 which is connected to the transmission line and to the gate of which the reference voltage is inputted to cause the thyristor circuit to flow a gate current to be turned on, bringing the command signal on the transmission line into cutting off oscillation to stop the oscillation of the control circuit.

8 Claims, 6 Drawing Sheets

SEPARATELY EXCITED INVERTER CIRCUIT AND LIQUID CRYSTAL DISPLAY TELEVISION

CROSS-REFERENCES TO RELATED APPLICATIONS

The present application is related to the Japanese Patent Application No. 2007-120706, filed May 1, 2007, the entire disclosure of which is expressly incorporated by reference herein.

BACKGROUND OF THE INVENTION

1. Field of the Invention

The present invention relates to a separately excited inverter circuit and a liquid crystal display (LCD) television, and in particular, to a separately excited inverter circuit with a full-bridge switching circuit and an LCD television whose backlight is illuminated by the separately excited inverter circuit.

2. Description of the Related Art

Electric and electronic appliances including an LCD television are legally obligated to take a short- and open-circuit test for safety. The short- and open-circuit test is conducted such that all the terminals of electric and electronic components are short- and open-circuited within AC voltage ±10%. The test is made to ascertain whether what abnormality is generated in a circuit.

It is needless to say that the test applies to a switching element (including a transistor and an FET) forming a switching circuit in the inverter circuit. The short circuit damage of any switching element in the switching circuit influences other switching elements forming the switching circuit to be liable to damage all the switching elements forming the switching circuit.

Hitherto, abnormality in an inverter circuit has been detected by a software control using a microcomputer. For example, a microcomputer monitors the current and voltage of a fluorescent tube connected to the inverter circuit to determine duration if the microcomputer detects an abnormal decrease in current and an abnormal increase in voltage. If the duration exceeds a predetermined time (for example, 350 milliseconds), the microcomputer determines the excess to be abnormal to shut down the inverter circuit. It has been essential to determine the duration to avoid malfunction.

However, it takes a very short time (for example, 20 microseconds to 40 microseconds in an oscillation of 50 kHz) to damage other switching elements after one switching element of the switch circuit has been short circuited and damaged, so that the microcomputer determining an abnormal voltage has been too late to prevent the short circuit damage.

As circuits for protecting a circuit at the time of the occurrence of abnormality in it there have been known circuits described in the following documents.

Japanese Patent Application Laid-Open No. 05-299990 describes that an avalanche diode and a thyristor are used to protect an FET from overvoltage surge of voltage inputted to the drain of the FET. That is to say, the surge voltage inputted into the drain of the FET is detected by the avalanche diode and the thyristor to the gate of which the detected signal is inputted is momentarily turned on to output the driving electric power to the gate of the FET.

Japanese Patent Application Laid-Open No. 2003-179472 describes that a protective circuit unit detects current flowing between the drain and the source of an FET through a current detecting unit to adjust the output voltage of a charge pump unit adjusting the gate voltage of the FET according to the detected result. The circuit suppresses current outputted from the drain of the FET to protect the element supplied with current through the FET.

Japanese Patent Application Laid-Open No. 2002-353795 describes that a circuit for protecting a switching element from overcurrent is configured such that a MOSFET is turned on when current flowing into the current detecting terminal of the switching element increases and the source of the MOSFET is connected to the gate of the switching element.

None of the techniques described in the abovementioned documents assume that a plurality of switching elements is provided unlike the present application and prevent other switching elements from being damaged owing to the short circuit damage of one switching element.

BRIEF SUMMARY OF THE INVENTION

The present invention has been made in view of providing a separately excited inverter circuit whose switching circuit having a plurality of switching elements and which is capable of minimizing the damage of the other switching elements even if any of the plurality of switching elements is short circuited and damaged and an LCD television equipped with the separately excited inverter circuit.

The present invention discloses a separately excited inverter circuit, comprising: a full bridge circuit that converts a direct current (DC) input voltage into an alternate current (AC) output voltage and that applies the AC voltage to a primary winding of a transformer; a control circuit for performing switching control of the full bridge circuit when receiving a command signal from a transmission line; a terminal voltage monitoring circuit that monitors a terminal voltage of a terminal for controlling a conduction of a switching element forming the full bridge circuit and that outputs a reference voltage when the terminal voltage exceeds a predetermined threshold; and a thyristor that is coupled with the transmission line; the thyristor having a gate to which the reference voltage is input to cause the thyristor to flow a gate current turn on to impede the command signal on the transmission line to thereby stop the oscillation of the control circuit.

That is to say, the terminal voltage monitoring circuit monitors a terminal voltage across a terminal for controlling the conduction of switching element forming of the full bridge circuit and outputs to the thyristor outputting a reference voltage when the terminal voltage exceeds a predetermined threshold. The thyristor is connected to a transmission line for transmitting the command signal for commanding the control circuit to start and stop oscillation, and to the gate of which the reference voltage is inputted to cause the thyristor to flow a gate current to be turned on, bringing the command signal on the transmission line into cutting off oscillation to stop the oscillation of the control circuit.

The thyristor is not necessarily a single thyristor element, but may be a thyristor circuit formed of a combination of an NPN transistor and a PNP transistor.

More specifically, the thyristor is of silicon controlled switch (SCS) type, its anode is supplied in advance with a fixed bias capable of turning on the thyristor, its cathode is grounded, its anode gate is connected to the transmission line for the command signal and the input of the reference voltage to the cathode gate turns on the thyristor. That is to say, the command signal is brought into a high-level voltage signal and the thyristor is turned on to bring the line for transmitting the command signal into low-level voltage, thereby enabling stopping the input of the command signal to the control circuit.

Incidentally, the terminal voltage monitoring circuits are not always provided correspondingly with all switching elements. For example, the full bridge circuit is realized by a combination of two half bridges, however, if one switching element forming one half bridge connection is short circuited and damaged, a high voltage is directly applied to the other switching elements, which may damage them at the same time.

For this reason, the terminal voltage monitoring circuit provided therein is equal in number to a half bridge connection forming the full bridge and each terminal voltage monitoring circuit monitors only any one of the switching elements forming opposing half bridge connections.

As more concrete configuration of the terminal voltage monitoring circuit, the terminal voltage monitoring circuit may be a comparator which compares a predetermined voltage with the terminal voltage to input the comparison result to the cathode gate of the thyristor and outputs a high-level voltage to turn off the thyristor if the terminal voltage is not greater than the predetermined threshold and a low-level voltage as a reference voltage to turn on the thyristor if the terminal voltage exceeds the predetermined threshold.

While the terminal voltage monitoring circuit and the thyristor are stopping the oscillation of the control circuit, completely stopping the separately excited inverter circuit and the power supply circuit for supplying the power supply voltage to the separately excited inverter circuit allows surely preventing the switching element from being damaged. Then, the command signal may be issued from the control unit, and the control unit monitors the secondary voltage generated in the secondary winding of the step-up transformer and stops the output of the command signal and the input of the DC voltage if the time when the secondary voltage deviates from the predetermined range exceeds a predetermined time.

Such a short circuit damage of the switching element may hardly occur when a user normally uses the television, but is liable to occur at the time of a short- and open-circuit test. The present invention is effective when decrease in the terminal voltage is caused by short circuit damage of the switching element. It is needless to say that the short circuit damage of the switching element except for the short- and open-circuit test is not excluded from the present invention.

A liquid crystal display (LCD) television to which the present invention is applied comprising: a separately excited inverter circuit for converting direct current (DC) input voltage into an alternate current (AC) output voltage in a separately excited switching circuit; a power supply circuit for supplying a DC voltage to the separately excited inverter circuit; a backlight for providing light from a back face of a liquid crystal panel by discharge lamps activated by the separately excited inverter circuit; and a microcomputer for controlling oscillation of the separately excited inverter circuit and the output of the DC voltage of the power supply circuit; the LCD television receiving a television broadcast signal to drive the liquid crystal panel by a driving signal produced from a video signal extracted from the television broadcast signal to display images on a screen; the separately excited inverter circuit, comprises: a smoothing circuit for outputting a smooth voltage in which ripples are removed from the input DC voltage; a switching circuit formed of a full bridge connection combining a first and a second half bridge connection; the smooth voltage is input to one end of the switching circuit with another end grounded; the switching circuit applying an AC voltage to a primary winding of a transformer; a feedback circuit for outputting a voltage in which the voltage of a secondary winding of the transformer is divided into a predetermined ratio as a feedback voltage; a driving circuit for performing the switching control of each MOSFET forming the full bridge circuit according to a frequency of an input frequency signal; a dimming control circuit for oscillating a predetermined frequency signal subjected to phase shift control between frequencies, between which the switching control of each of the MOSFETs is performed to suppress a fluctuation of the feedback voltage and output the frequency signal to the driving circuit; a comparator having an inverting input terminal with a voltage corresponding to the gate voltage of any one of the MOSFETs in any of the half bridge connection input thereto; and a non-inverting input terminal with a predetermined comparing voltage input thereto the non-inverting input terminal; the comparator outputting a low-level voltage when a switching driving signal is input to the gate of the MOSFET and a high-level voltage when the MOSFET is short circuited and damaged; and a thyristor circuit including a PNP-type first transistor and a NPN-type second transistor; the microcomputer inputs a high-level voltage signal commanding the dimming control circuit to oscillate; the first transistor has a base connected to a collector of the second transistor and to the transmission line for transmitting the voltage signal for controlling the oscillation of the dimming control circuit, an emitter inputted the smoothened voltage, and a collector coupled with a base of the second transistor and grounded through another resistor and coupled with an anode of a Zener diode that is not broken down by the low-level voltage output by the comparator, but does break down by the high-level voltage output by the comparator, and the collector coupled with the output terminal of the comparator through the Zener diode, the second transistor has an emitter that is grounded, when the Zener diode is broken down by the high-level voltage signal output from one or both of the comparator, the high-level voltage signal is input to the base of the second transistor through a resistor to turn on the second transistor and then the first transistor; the transmission line of the high-level signal for commanding the dimming control circuit to oscillate by the microcomputer is grounded through the second transistor to stop the dimming control circuit from oscillating, which stops the driving circuit from switch controlling the switching circuit; and the microcomputer acquires the feedback voltage, outputs a command signal for commanding the dimming control circuit to stop oscillating when the microcomputer detects that the feedback voltage is kept low for a predetermined time period and stops the output of the DC voltage of the power supply circuit.

According to the present invention described above, stopping the input of the command signal into the control circuit using the thyristor substantially at the same time when the switching element is damaged enables providing the separately excited inverter circuit capable of minimizing the sequential damage of the switching element forming the full bridge circuit to minimize time and effort for repair work and cost.

According to a second aspect of the invention, a thyristor circuit using a transistor can be realized at a reasonable cost to reduce the cost as compared with the case where a single thyristor element is used.

According to a third aspect of the invention, a high/low level voltage signal generally used in a command signal can be used.

According to a fourth aspect of the invention, the number of terminal voltage monitoring circuits is reduced, which however provides the same effect as the case where all switching elements are monitored, resulting in effective use of space on a substrate and cost reduction.

According to a fifth aspect of the invention, the terminal voltage monitoring circuit can be realized by a simple circuit configuration.

According to a sixth aspect of the invention, the switching element can be surely prevented from being damaged.

According to a seventh aspect of the invention, the damage of the switching element can be minimized to minimize time and effort for repair work and cost.

It is needless to say that a more concrete configuration according to an eighth aspect of the invention achieves the same effect as the inventions according to the first to seventh aspects described above.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding parts throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

For purposes of illustration, programs and other executable program components are illustrated herein as discrete blocks, although it is recognized that such programs and components may reside at various times in different storage components, and are executed by the data processor(s) of the computers. The embodiment of the present invention is described below in accordance with the following order.

(1) Configuration of LCD television
(2) Configuration of inverter circuit
(3) Configuration of protective circuit
(4) Conclusion

(1) Configuration of LCD Television

Figure 1:
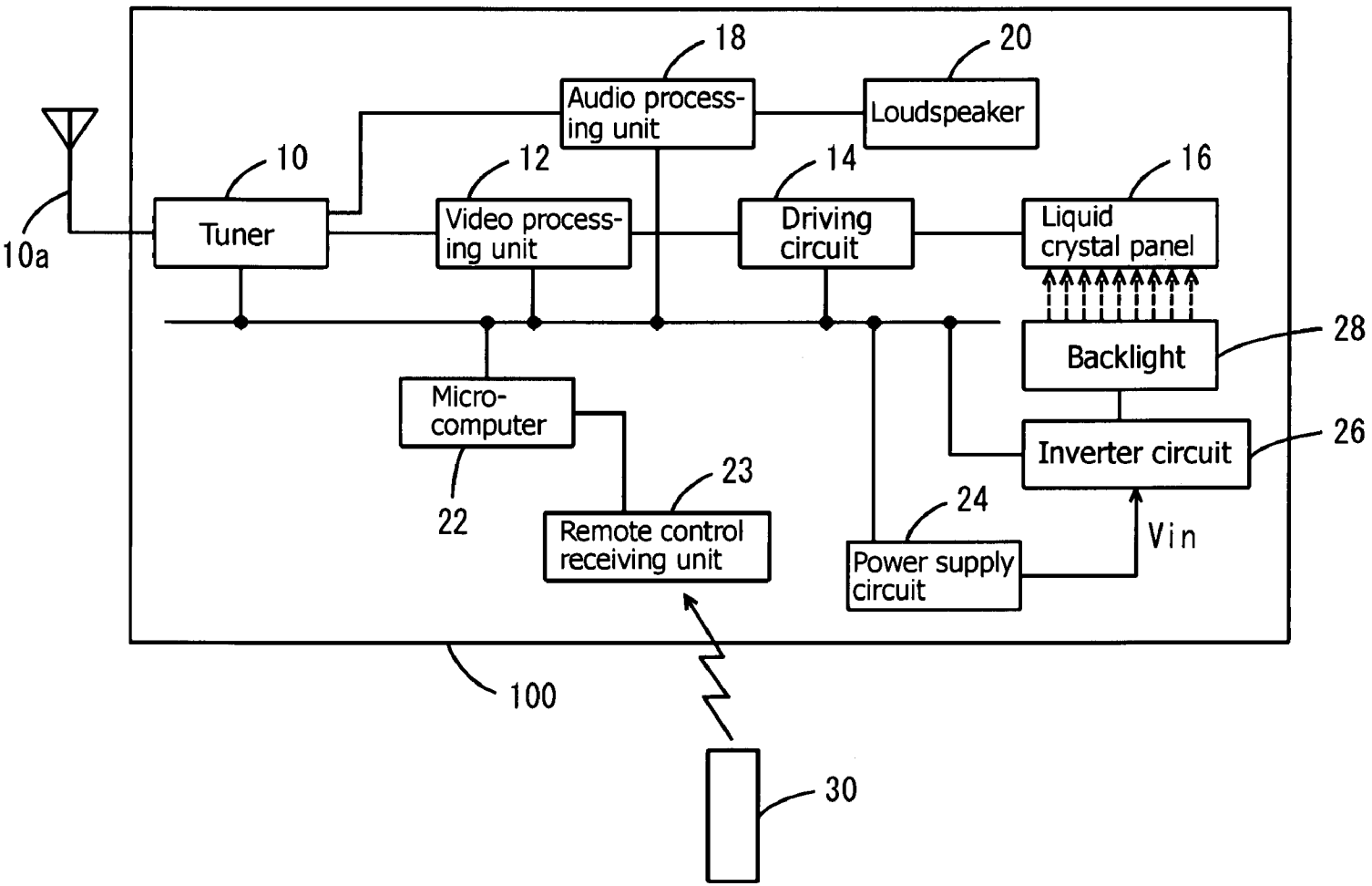
FIG. 1 is a block diagram illustrating the configuration of an LCD television equipped with a separately excited inverter circuit according to the present invention.

The embodiment of the present invention is described below with reference to FIGS. 1 to 6. FIG. 1 is a block diagram illustrating the configuration of an LCD television 100 equipped with a separately excited inverter circuit according to the present invention. Portions which are not directly related to the present invention are omitted from the figures. Although an LCD television is taken as an example for description in the present embodiment, any electric and electronic appliance equipped with the separately excited inverter circuit according to the present invention may be taken as an example.

The LCD television 100 includes a tuner 10 for receiving a television broadcast signal having a selected frequency, a video processing unit 12 for subjecting a video signal extracted from the television broadcast signal to various video processings, an audio processing unit 18 for subjecting an audio signal extracted from the television broadcast signal to various audio processings, a driving circuit 14 for generating a driving signal based on the video signal to drive a liquid crystal panel 16, a microcomputer 22 for controlling the entire LCD television 100, a remote control receiving unit 23 for receiving a remote control signal from a remote controller 30 to output a corresponding voltage signal to the microcomputer 22, a backlight 28 for illuminating a liquid crystal panel 16 from its back by a plurality of fluorescent tubes, an inverter circuit 26 for supplying an AC voltage for lighting the backlight 28 and a power supply circuit 24 for generating various voltages from an AC power supply such as a commercial power supply to supply a power supply voltage to each portion of the LCD television 100. Although the power supply circuit 24 in FIG. 1 supplies a power supply voltage only to the inverter circuit 26, it is needless to say that the power supply circuit 24 supplies a power supply voltage to other circuits.

More specifically, the tuner 10 receives a television broadcast signal having a predetermined frequency by the control of the microcomputer 22 through an antenna 10*a*, extracts a video and audio signals as an intermediate signal from the television broadcast signal while performing a predetermined signal amplifying process and outputs a video signal to the video processing unit 12 and an audio signal to the audio processing unit 18.

The video processing unit 12 digitizes an input video signal according to its signal level and subjects the digitized signal to a matrix conversion processing based on a luminance signal and a color difference signal extracted from the video signal to generate RGB (red, green and blue) signals as video data. The video processing unit 12 subjects the RGB signals to a scaling operation matching with the number of pixels (an aspect ratio of m:n) of the liquid crystal panel 16 to produce video data of one screen displayed on the liquid crystal panel 16 to output the produced video data to the driving circuit 14. The driving circuit generates a driving signal according to the inputted video data to drive each display cell of the liquid crystal panel 16 to display pictures on the screen.

The inverter circuit 26 is supplied with DC voltage by the power supply circuit 24, generates a high AC voltage having a high frequency from the DC voltage to supply it to the backlight 28. The backlight 28 includes a plurality of fluorescent tubes and is lit by the supplied AC voltage to act as a light source for illuminating the liquid crystal panel 16 from the back face thereof.

The microcomputer 22 is electrically connected to each portion forming the LCD television 100. A CPU as a component inside the microcomputer 22 controls the entire television 100 while using a RAM as a work area according to each program written in a ROM being a component inside the microcomputer 22. The CPU, ROM and RAM are omitted from the figure. As an example of the control of the microcomputer 22, when the microcomputer 22 receives the input of a voltage signal from the remote control receiving unit 23 by the control of the CPU and detects a corresponding key operation, the microcomputer 22 receives an operational input from the remote controller 30 and controls correspondingly to the received operational input.

(2) Configuration of Inverter Circuit

Figure 2:
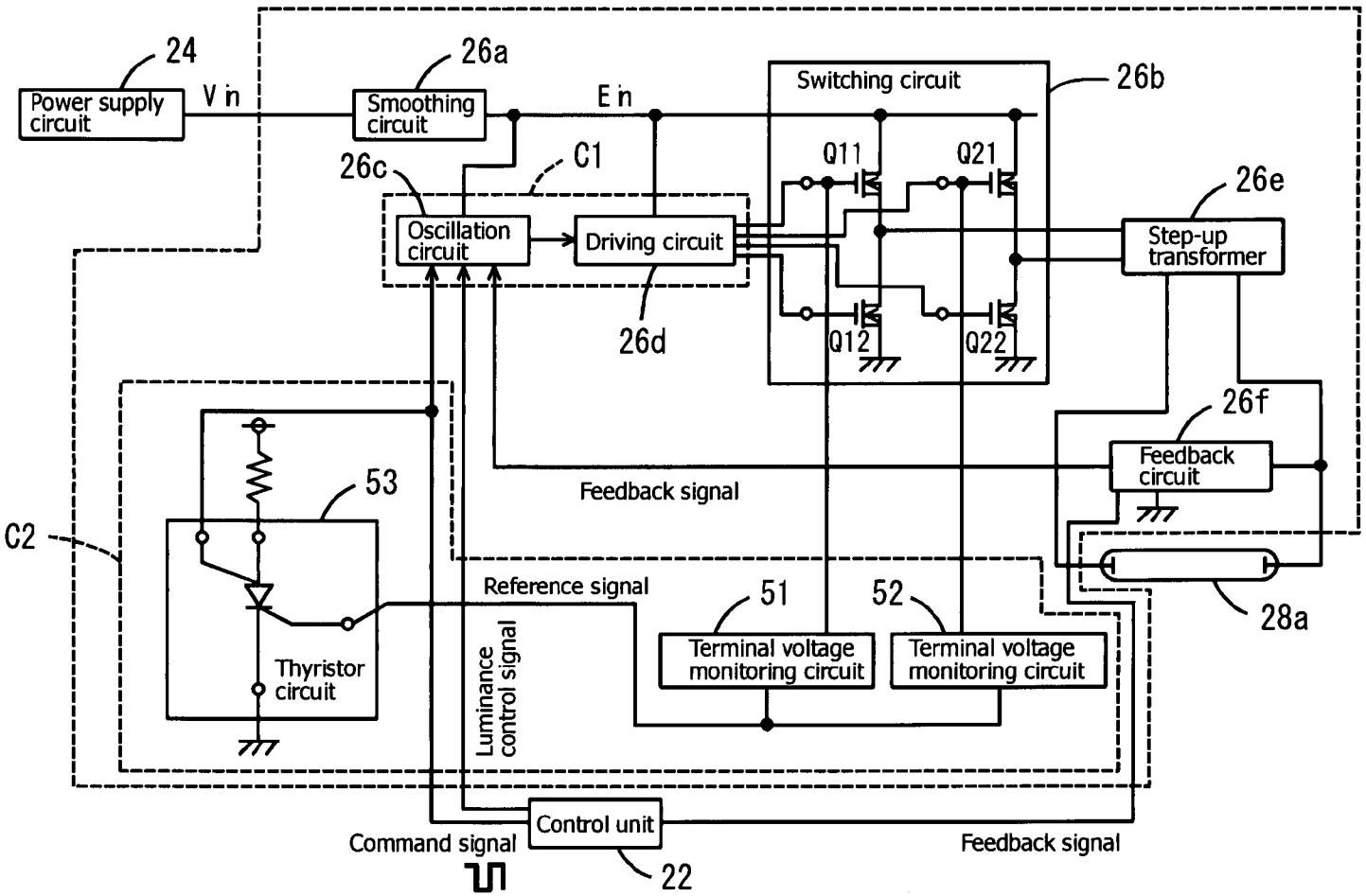
FIG. 2 is a block diagram illustrating the configuration of an inverter circuit.
Figure 3:
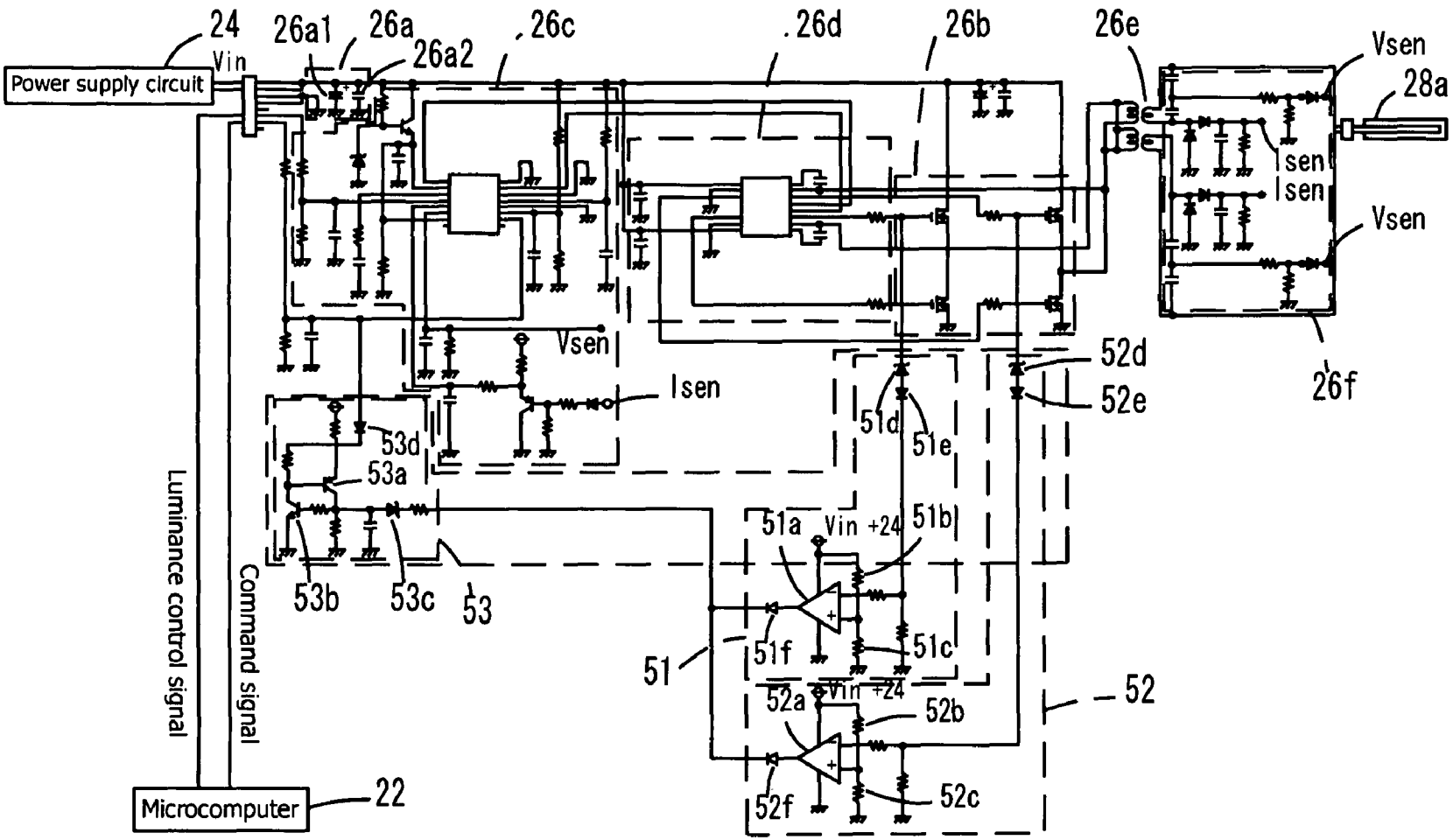
FIG. 3 is a circuit diagram of the inverter circuit according to a first embodiment of the present invention.
Figure 4:
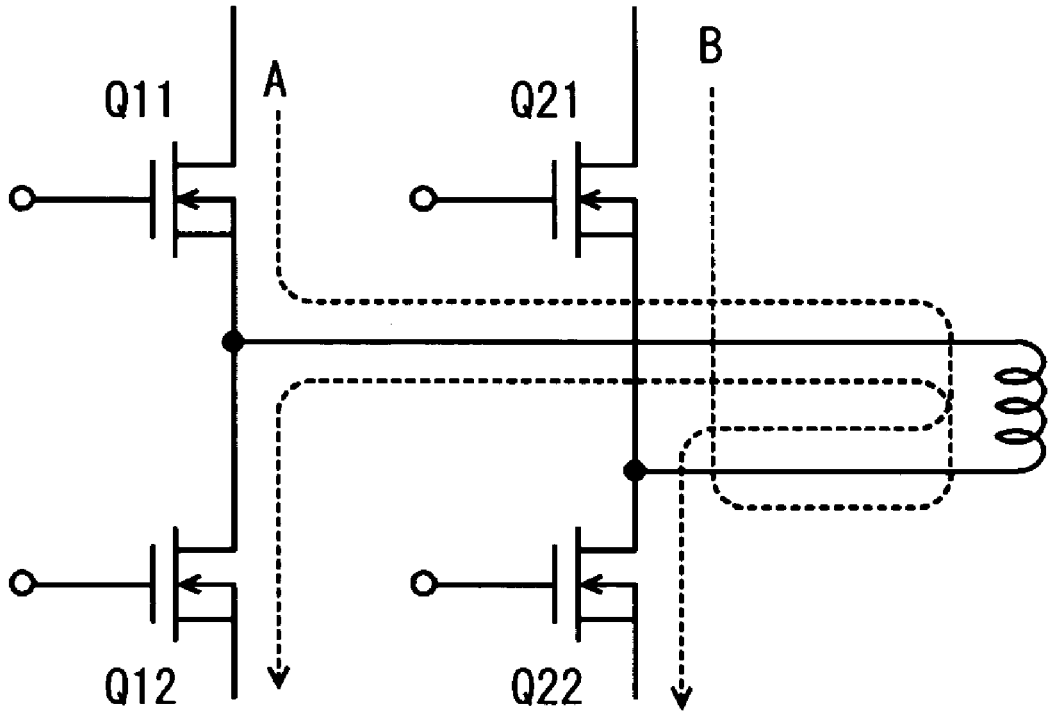
FIG. 4 is a schematic diagram describing the operation of a full bridge circuit.
Figure 6:
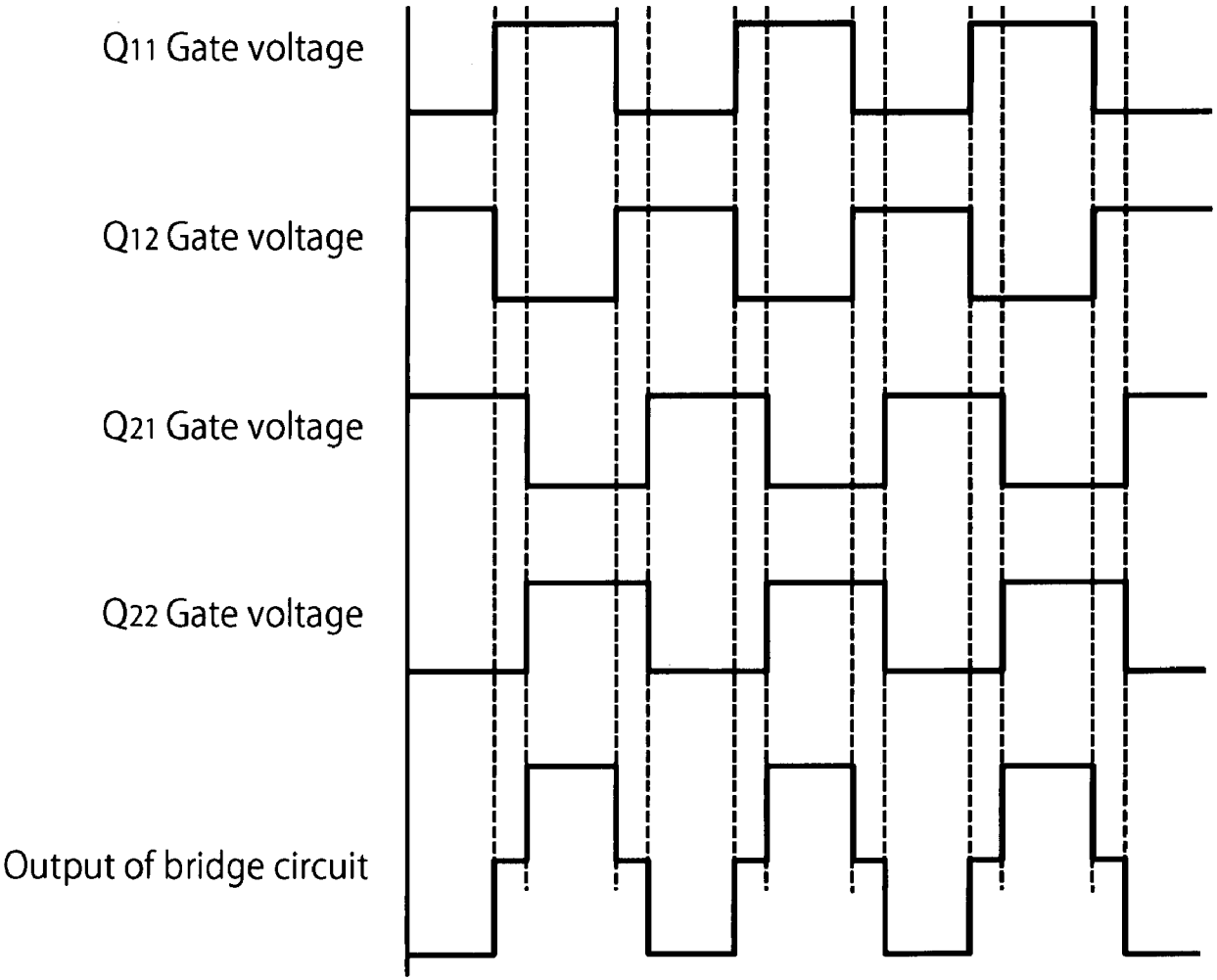
FIG. 6 is a schematic diagram describing a phase shift control.

The inverter circuit 26 is described below with reference to FIGS. 2 to 4 and 6. FIG. 2 is a block diagram illustrating the configuration of the inverter circuit 26. FIG. 3 is a circuit diagram according to a first embodiment of the present invention. FIG. 4 is a schematic diagram describing the operation of a full bridge circuit. FIG. 6 is a schematic diagram describing a phase shift control. The inverter circuit 26 is a separately excited inverter circuit and generates an inverter voltage by a full bridge circuit.

The inverter circuit 26 is composed of a smoothing circuit 26*a*, a switching circuit 26*b*, a dimming control circuit 26*c*, a driving circuit 26*d*, a step-up transformer 26*e*, a feedback circuit 26*f*, terminal voltage monitoring circuits 51 and 52 and a thyristor circuit 53. The inverter circuit 26 is driven by a DC voltage Vin inputted from the power supply circuit 24 and generates a voltage for lighting a cold cathode tube.

That is to say, the DC voltage Vin is inputted into the switching circuit 26*b* through the smoothing circuit 26*a*, converted to an AC having a desired frequency by the changeover of the switch elements and generated as a secondary voltage through the step-up transformer 26*e*, and the secondary voltage is supplied to a cold cathode tube 28*a* (discharge tube). The cold cathode tube 28*a* forms a part of the backlight 28. Although FIGS. 2 and 3 illustrate one unit of the switching circuit 26*b*, the step-up transformer 26*e* and the feedback circuit 26*f*, it is needless to say that these units vary in number with the cold cathode tube 28*a*. The changeover of the switching circuit 26*b* is controlled by a control circuit C1 formed of the dimming control circuit 26*c* and the driving circuit 26*d*. A more concrete circuit configuration is described below.

The inverter circuit 26 includes the smoothing circuit 26*a* which is composed of capacitors 26*a*1 and 26*a*2 for removing ripples from the inputted DC voltage Vin and supplies the DC voltage Vin as a smoothed voltage Ein to the switching circuit 26*b* located at the rear stage of the smoothing circuit 26*a*.

The switching circuit 26*b* is a separately excited inverter circuit in which four MOS-FETs Q11, Q12, Q21 and Q22 are connected in full bridge form. The full bridge connection is formed of a combination of a half bridge connection (a first half bridge connection) of a pair of the MOS-FETs Q11 and Q12 and a half bridge connection (a second half bridge connection) of a pair of the MOS-FETs Q21 and Q22. In the present embodiment, although the full bridge circuit uses the MOS FETS, it is needless to say that it may use other transistor elements.

The half bridge connection of a pair of the MOS-FETs Q11 and Q12 is formed such that the drain of the MOS-FET Q11 is connected to a line of the smoothed voltage Ein, the source of the MOS-FET Q11 is connected to the drain of the MOS-FET Q12 and the source of the MOS-FET Q12 is grounded. Similarly, the half bridge connection of a pair of the MOS-FETs Q21 and Q22 is formed such that the drain of the MOS-FET Q21 is connected to a line of the smoothed voltage Ein, the source of the MOS-FET Q21 is connected to the drain of the MOS-FET Q22 and the source of the MOS-FET Q22 is grounded.

The junction point (a switching output point) between the source of the MOS-FET Q11 and the drain of the MOS-FET Q12 is connected to one end of the primary winding of the step-up transformer 26*e*, and the other end of the step-up transformer 26*e* is connected to the junction point (a switching output point) between the source of the MOS-FET Q21 and the drain of the MOS-FET Q22.

A command signal for commanding the dimming control circuit 26*c* to turn on-off its oscillation is inputted to the dimming control circuit 26*c* from the microcomputer 22. When the dimming control circuit 26*c* receives a high-level voltage signal (command signal) for commanding it to turn on its oscillation and a luminance control signal for directing duty at a predetermined period (for example, 200 MHz) from the microcomputer 22, the dimming control circuit 26*c* oscillates a signal having a required switching frequency (for example, 46 kHz) matching with the duty corresponding to the luminance control signal and outputs the signal to the driving circuit 26*d*. That is to say, the dimming control circuit 26*c* oscillates the frequency signal during the duty-on period in the luminance control signal, but does not oscillate it during the duty-off period. For example, the duty in the case where display at the maximum luminance is selected is 100%, at this point, the dimming control circuit 26*c* always oscillates the frequency signal. The driving circuit 26*d* outputs a switching driving signal to the gates of the MOS-FETs Q11, Q12, Q21 and Q22 in accordance with the frequency signal.

At this point, the driving circuit 26*d* controls the MOS-FETs Q11 and Q22 so that they are turned on and off substantially at the same timing and the MOS-FETs Q12 and Q21 so that they are turned on and off substantially at the same timing. This means that the MOS-FETs Q11 and Q12 are turned on and off alternately and the MOS-FETs Q21 and Q22 are turned on and off alternately. However, the on- and off-timing of the MOS-FETs Q11 and Q22 and the MOS-FETs Q12 and Q21 may be shifted within the range of up to a half period of the switching frequency owing to the phase shift control described later.

When the MOS-FETs Q11 and Q22 are turned on, the MOS-FETs Q12 and Q21 are turned off, so that current flows in the order of a route A in FIG. 4 (from the MOS-FET Q11 to the ground through the primary winding of the step-up transformer and the MOS-FET Q22). On the other hand, when the MOS-FETs Q12 and Q21 are turned on, the MOS-FETs Q11 and Q22 are turned off, so that current flows in the order of a route B in FIG. 4 (from the MOS-FET Q21 to the ground through the primary winding of the step-up transformer and the MOS-FET Q12). Thus, the switching circuit 26*b* performs the full-bridge switching operation in which an AC voltage is applied to (or, voltages whose phases are inverted to each other are alternately applied to) the primary winding of the step-up transformer.

The feedback circuit 26*f* supplies the dimming control circuit 26*c* with a feedback voltage Vsen and a feedback current Isen corresponding in level to the variation of a secondary voltage E2 (for example, tube voltage) and a secondary current I2 (for example, tube current). For example, as illustrated in FIG. 3, a voltage in which the secondary voltage outputted from the secondary winding of the step-up transformer 26*e* is divided by a division capacitor and dropped to a predetermined ratio is used as the feedback voltage Vsen for feeding back the tube voltage. In addition, as illustrated in FIG. 3, a current in which the secondary current of the step-up transformer 26*e* is rectified by a diode and ripples are removed by a capacitor is used as the feedback current Isen for feeding back the tube current. The feedback voltage Vsen and the feedback current Isen are fed back to the dimming control circuit 26*c*.

Figure 5:
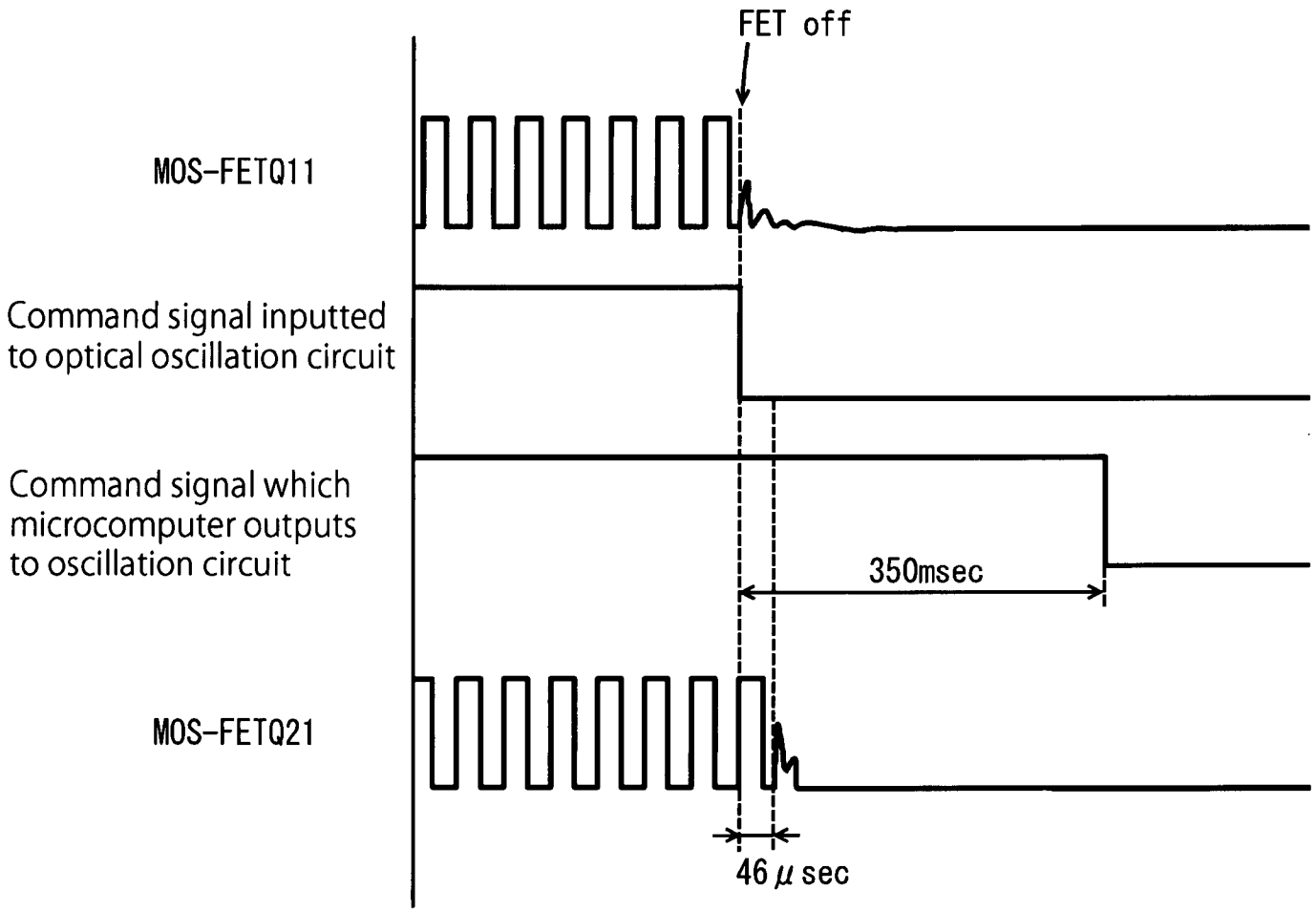
FIG. 5 is a timing chart of the inverter circuit.

The dimming control circuit 26*c* performs a phase shift control illustrated in FIG. 5 based on the feedback voltage Vsen and the feedback current Isen to vary the on-duty ratio of the switching circuit 26*b*. More specifically, the dimming control circuit 26*c* performs a control in which phase differences between the switching frequencies of the MOS-FETs Q11 and Q12 and between the switching frequencies of the MOS-FETs Q21 and Q22 are produced. For example, the decrease of the secondary current I2 causes the dimming control circuit 26*c* to increase the on-duty of the switching circuit 26*b*. That is to say, this means that the driving circuit 26*d* performs the control operation to extend the time when the MOS-FETs Q11 and Q22 are simultaneously turned on and the MOS-FETs Q21 and Q12 are simultaneously turned on. Thus, the duty of the voltage transmitted to the secondary side is varied to perform the constant current control for moderating fluctuation in the feedback voltage.

The feedback voltage Vsen outputted from the feedback circuit 26*f* is also outputted to the microcomputer 22. The microcomputer 22 receives the feedback voltage Vsen inputted therein at a predetermined time interval to determine whether the value indicated by the feedback voltage Vsen deviates from a predetermined range. If the microcomputer 22 consecutively receives the feedback voltage Vsen indicating deviation plural times, the microcomputer 22 determines that the secondary voltage E2 is abnormally generated to shut down the inverter circuit. The reason why the condition that the feedback voltage Vsen is consecutively received plural times is established is that malfunction is prevented from being caused by a transient fluctuation in voltage such as a noise. That is to say, the microcomputer 22 lowers a high-level voltage outputted to the dimming control circuit 26*c* to a low-level voltage to stop the oscillation of the dimming control circuit 26*c*. At this point, the microcomputer 22 may cause the power supply circuit 24 to stop the output of power supply.

(3) Configuration of Protective Circuit

A protective circuit C2 is composed of the terminal voltage monitoring circuits 51 and 52 and the thyristor circuit 53. If any of the MOS-FETs Q11, Q12, Q21 and Q22 in the switching circuit 26*b* is short circuited and damaged, the protective circuit C2 protects the other MOS-FETs from damage. The protective circuit C2 is described below.

The terminal voltage monitoring circuit 51 monitors the gate voltage of the MOS-FET Q11 forming the switching circuit 26*b* and outputs a reference voltage to the thyristor circuit if the gate voltage exceeds a predetermined voltage. Similarly, the terminal voltage monitoring circuit 52 monitors the gate voltage of the MOS-FET Q21 of the switching circuit 26*b* and outputs a reference voltage to the thyristor circuit if the gate voltage exceeds a predetermined voltage. The gates of the MOS-FETs correspond to terminals for controlling the conduction of the switching elements.

The thyristor circuit 53, whose gate is applied with the reference voltage from any of the terminal voltage monitoring circuits 51 and 52, causes a gate current to flow therein to be turned on, bringing a high-level voltage signal on the transmission line which commands the dimming control circuit 26*c* to oscillate into a low-level voltage signal to stop the oscillation of the dimming control circuit 26*c*.

The protective circuit C2 is described in detail below.

The terminal voltage monitoring circuit 51 is formed of a Zener diode 51*d* the cathode of which is connected to the gate of the MOS-FET Q11, a diode 51*e* the anode of which is connected to the anode of the Zener diode 51*d*, a comparator 51*a* and a diode 51*f* the anode of which is connected to the output terminal of the comparator 51*a*. The cathode of the diode 51*f* is grounded through a resistor.

A comparing voltage, in which the DC voltage Vin of the inverter circuit 26, is divided into a predetermined voltage by resistors 51*b* and 51*c* is inputted to the non-inverting input terminal of the comparator 51*a* and the inverting input terminal thereof is connected to the cathode of the diode 51*e* through a resistor. The anode of the diode 51*e* is connected to that of the Zener diode 51*d*, and the diode 51*e* is formed so as to pass an inverse current, i.e., breakdown current of the Zener diode 51*d* the cathode of which is connected to the gate of the MOS-FET Q11.

The Zener diode 51*d* is selected by the driving circuit 26*d* so that it is broken down at a voltage level applied to the gate of the MOS-FET Q11. The voltage inputted to the inverting input terminal of the comparator 51*a* is set to be lower than the voltage inputted to the inverting input terminal thereof when the Zener diode 51*d* is broken down.

That is to say, a difference voltage is positive at the time of the normal operation of the MOS-FET Q11, so that the comparator 51*a* outputs a low-level voltage. Therefore, the thyristor circuit 53 is not turned on. On the other hand, when the MOS-FET Q11 is short circuited and damaged to lower the gate voltage, the Zener diode 51*d* is not broken down and a voltage lower than that applied to the non-inverting input terminal is inputted to the inverting input terminal of the comparator 51*a*, so that the difference voltage becomes negative. As a result, the comparator 51*a* outputs a high-level voltage. In other words, the comparator 51*a* compares the DC voltage Vin with the gate voltage of the MOS-FET Q11 and outputs a comparison result to the cathode gate of the thyristor circuit 53.

Similarly, the terminal voltage monitoring circuit 52 is formed of a Zener diode 52*d* the cathode of which is connected to the gate of the MOS-FET Q21, a diode 52*e* the anode of which is connected to the anode of the Zener diode 52*d*, a comparator 52*a* and a diode 52*f* the anode of which is connected to the output terminal of the comparator 52*a*. The cathode of the diode 52*f* is grounded through a resistor.

A comparing voltage, in which the DC voltage Vin of the inverter circuit 26 is divided into a predetermined voltage by resistors 52*b* and 52*c*, is inputted to the non-inverting input terminal of the comparator 52*a* and the inverting input terminal thereof is connected to the cathode of the diode 52*e* through a resistor. The anode of the diode 52*e* is connected to that of the Zener diode 52*d*, and the diode 52*e* is formed so as to pass an inverse current, i.e., breakdown current of the Zener diode 52*d* the cathode of which is connected to the gate of the MOS-FET Q11.

The Zener diode 52*d* is selected by the driving circuit 26*d* so that it is broken down at a voltage level applied to the gate of the MOS-FET Q11. The voltage inputted to the inverting input terminal of the comparator 52*a* is set to be lower than the voltage inputted to the inverting input terminal when the Zener diode 52*d* is broken down.

That is to say, a difference voltage is positive at the time of the normal operation of the MOS-FET Q11, so that the comparator 52*a* outputs a low-level voltage. Therefore, the thyristor circuit 53 is not turned on. On the other hand, when the MOS-FET Q11 is short circuited and damaged to lower the gate voltage, the Zener diode 52*d* is not broken down and a voltage lower than that applied to the non-inverting input terminal is inputted to the inverting input terminal of the comparator 52*a*, so that the difference voltage becomes negative. As a result, the comparator 52*a* outputs a high-level voltage. In other words, the comparator 52*a* compares the DC voltage Vin with the gate voltage of the MOS-FET Q21 and outputs a comparison result to the cathode gate of the thyristor circuit 53.

The thyristor circuit 53 is described below. The thyristor circuit 53 is of a silicon controlled switch (SCS) type. In the present embodiment, the circuit is formed of a combination of an NPN transistor 53*b* and a PNP transistor 53*a*. It is needless to say that a single thyristor element may be used in the thyristor circuit 53. It may be properly selected based on a balance between a substrate space and cost whether to use a single thyristor element. A thyristor used in the thyristor circuit 53 is not limited to the SCS, but various types of thyristors such as a silicon controlled rectifier (SCR) and a bidirectional triode thyristor or equivalent circuits thereof may be used.

The base of the transistor 53*a* is connected to the collector of the transistor 53*b*, the DC voltage Vin is inputted to the emitter of the transistor 53*a* through a resistor as a fixed bias, and a gate current flowing into the cathode gate of the thyristor circuit 53 turns it on. The collector of the transistor 53*a* is grounded through a resistor. The base of the transistor 53*a* is connected through a resistor and a diode to a transmission line for transmitting a voltage signal by which the microcomputer 22 commands the dimming control circuit 26*c* to oscillate. The diode is connected so as to be in the forward direction from the transmission line to the base of the transistor 53*a*.

The collector of the transistor 53*a* is connected to the base of the transistor 53*b* through a resistor. The collector of the transistor 53*a* is also connected to the anode of the Zener diode 53*c* and to the output terminals of the terminal voltage monitoring circuits 51 and 52 through the Zener diode 53*c*. The emitter of the transistor 53*b* is grounded.

That is to say, the collector terminal of the transistor 53*a* and the terminals directly connected thereto correspond to the cathode gate of the thyristor circuit 53 and the emitter terminal of the transistor 53*b* corresponds to the cathode the thyristor circuit 53. The emitter terminal of the transistor 53*a* corresponds to the anode of the thyristor circuit 53. The base terminal of the transistor 53*a* and the collector terminal of the transistor 53*b* connected thereto correspond to the anode gate of the thyristor circuit 53. The thyristor circuit 53 of the present invention can be realized even by use of a single thyristor element in accordance with the above corresponding relationship.

In the above configuration, when the Zener diode 53*c* is broken down by a high-level voltage outputted from any or both of the terminal voltage monitoring circuits 51 and 52, the high-level signal is inputted to the base of the transistor 53*b* through a resistor. Then, the transistor 53*b* is turned on and then the transistor 53*a* is also turned on. The transmission line for transmitting a high-level voltage signal commanding the dimming control circuit 26*c* to oscillate is grounded through the transistor 53*b*, stopping the oscillation of the dimming control circuit 26*c*. Accordingly, the driving circuit 26*d* also stops the switch control of the switching circuit 26*b*.

Although the terminal voltage monitoring circuits are connected to the MOS-FETs Q11 and Q21 in the abovementioned embodiment, the present invention is not limited to this configuration. For example, all the MOS-FETs of the full bridge circuit may be provided with the terminal voltage monitoring circuits.

However, if the MOS-FET Q11 is short circuited and damaged, the MOS-FET Q12 may also be damaged at the same time because the DC voltage Vin is directly applied to the MOS-FET Q12 paired with the MOS-FET Q11 in the half bridge connection with the MOS-FET Q12 being turned off. For this reason, only any one of the MOS-FETs forming the half bridge connection is monitored to set the number of the terminal voltage monitoring circuits to be two, thereby reducing the cost and effectively using the substrate space. Although the present embodiment is described as one example of the above configuration, combinations of Q11 and Q22, Q12 and Q21*m* Q12 and Q22 are also available as is the case with Q11 and Q21. Any of the above combinations can provide the same effect as the combination of the present embodiment.

The operation of the present embodiment with the above configuration is described below.

FIG. 5 is a timing chart of the inverter circuit 26. The timing chart illustrates on-off timing of the MOS-FET Q11, a command signal inputted to the dimming control circuit 26*c*, a command signal outputted from the microcomputer to the inverter circuit 26 and on-off timing of the MOS-FET Q21 at the time of taking a short- and open-circuit test of the MOS-FET Q11.

As illustrated in the figure, before the MOS-FET Q11 is short circuited and damaged, the microcomputer 22 outputs a command signal to the dimming control circuit 26*c*, causing the MOS-FETs Q11 and Q21 to alternately repeat turning on and off according to the control of the driving circuit 26*d*. Then, a short- and open-circuit test of the MOS-FET Q11 is taken to short circuit and damage the MOS-FET Q11. At this point, the terminal voltage monitoring circuit 51 detects lowering in gate voltage of the MOS-FET Q11, so that the reference voltage outputted from the terminal voltage monitoring circuit 51 changes from a low to a high level. The reference voltage is inputted to the cathode gate of the thyristor circuit 53 to turn on the thyristor circuit 53 to bring the line transmitting the command signal to the dimming control circuit 26*c* into a low-level voltage. For this reason, as soon as the MOS-FET Q11 is short circuited and damaged, the command signal inputted to the dimming control circuit 26*c* is stopped substantially at the same time. The switching circuit 26*b* stops oscillation in several tens of seconds to prevent the MOS-FET Q21 from being sequentially damaged.

The MOS-FET Q11 is thus damaged to cause abnormality on the output voltage of the inverter circuit 26, thereafter, stopping oscillation itself by the function of the protective circuit. The microcomputer 22 monitoring the output of the feedback circuit 26*f* detects the abnormality and stoppage of the output voltage, determines whether the detection is abnormal or not and stops the output of the command signal after several hundred milliseconds. At this point, the microcomputer 22 may cause the power supply circuit 24 to stop the supply of voltage at the same time.

(4) Conclusion

The separately excited inverter circuit includes: the switching circuit 26*b* whose the full bridge circuit applies an AC voltage to the primary winding of the step-up transformer 26*e*; the control circuit C1 performing switching control of the switching circuit 26*b* when a command signal for commanding the control circuit C1 to oscillate is inputted thereto from the transmission line for transmitting the command signal for commanding it to start and stop oscillation; the terminal voltage monitoring circuits 51 and 52 monitoring the gate terminal voltages of the MOS-FETs forming the switching circuit 26*b* and outputting the reference voltage when the gate voltage exceeds the predetermined threshold; and the thyristor circuit 53 being connected to the transmission line of the command signal and turned on when the reference voltage is inputted to the gate thereof, bringing the command signal on the transmission line into off oscillation to stop the oscillation of the control circuit C1. Thus, the separately excited inverter circuit includes the switching circuit having a plurality of switching elements and, even if any of the plurality of switching elements is short circuited and damaged, the circuit is capable of minimizing the damage of the other switching elements.

It is needless to say that the present invention is not limited to the above embodiment. It is to be understood for those skilled in the art that the following are disclosed as one embodiment of the present invention:

a combination of mutually replaceable members and configuration disclosed in the present embodiment is properly changed and applied;

although not disclosed in the present embodiment, the members and configuration which are known art and disclosed in the present embodiment are properly substituted with mutually replaceable members and configuration and the combination thereof is changed and applied; and although not disclosed in the present embodiment, those skilled in the art properly substitute the members and configuration disclosed in the present embodiments with the members and configuration presumed as a substitute for the members and configuration disclosed in the present embodiments or change a combination thereof to be applied.

While the invention has been particularly shown and described with respect to preferred embodiments thereof, it should be understood by those skilled in the art that the foregoing and other changes in form and detail may be made therein without departing from the sprit and scope of the invention as defined in the appended claims.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. A separately excited inverter circuit, comprising:

a step-up transformer having a primary winding and a secondary winding;

a full bridge circuit that is coupled with the primary winding of the step-up transformer, converts a direct current (DC) input voltage into an alternate current (AC) output voltage, and applies the AC output voltage to the primary winding of the step-up transformer;

a control circuit that is coupled with a command signal transmission line, and performs switching control of the full bridge circuit when receiving a command signal from the command signal transmission line;

a terminal voltage monitoring circuit that monitors a terminal voltage of a gate of a first switching element forming the full bridge circuit; and a thyristor that is coupled with the command signal transmission line;

wherein the full bridge circuit has a half bridge connection;

the half bridge connection has the first switching element and a second switching element;

a source of the first switching element is connected to a switching output point;

a gate of the first switching element is connected to the control circuit;

a drain of the second switching element is connected to the switching output point;

a gate of the second switching element is connected to the control circuit;

the switching output point is connected to the primary winding of the step-up transformer;

the terminal voltage monitoring circuit is connected to the gate of the first switching element;

the terminal voltage monitoring circuit outputs a reference voltage to a gate of the thyristor when the terminal voltage of the gate of the first switching element is not greater than a predetermined voltage;

when the reference voltage from the terminal voltage monitoring circuit is input to the gate of the thyristor, a gate current flows through the thyristor, and the thyristor turns on and impedes the command signal on the command signal transmission line to thereby stop the oscillation of the control circuit.

2. The separately excited inverter circuit according to claim 1, wherein the thyristor is realized by a thyristor circuit including a combination of an NPN transistor and a PNP transistor.

3. The separately excited inverter circuit according to claim 1, wherein the thyristor is of silicon controlled switch (SCS) type, its anode is supplied with a fixed bias capable of turning on the thyristor, its cathode is grounded, its anode gate is connected to the command signal transmission line and the input of the reference voltage to the cathode gate turns on the thyristor.

4. The separately excited inverter circuit according to claim 1, wherein the terminal voltage monitoring circuit provided therein is equal in number to the half bridge connection forming the full bridge.

5. The separately excited inverter circuit according to claim 1, wherein the terminal voltage monitoring circuit has a comparator that compares a predetermined voltage with the terminal voltage to input the comparison result to the cathode gate of the thyristor.

6. The separately excited inverter circuit according to claim 1, wherein the command signal is outputted from a microcomputer, and the microcomputer monitors the secondary voltage generated in the secondary winding of the transformer and stops the output of the command signal and the input of the DC voltage if the time that the secondary voltage deviates from the predetermined range exceeds a predetermined time.

7. The separately excited inverter circuit according to claim 1, wherein a dropping of the terminal voltage is caused by short circuit failure at short- and open-circuit test for the switching element.

8. A liquid crystal display (LCD) television, comprising:

a separately excited inverter circuit;

a power supply circuit for supplying a direct current (DC) voltage to the separately excited inverter circuit;

a backlight for providing light from a back face of a liquid crystal panel by discharge lamps activated by the separately excited inverter circuit; and a microcomputer for controlling oscillation of the separately excited inverter circuit and the output of the DC voltage of the power supply circuit;

the LCD television receiving a television broadcast signal to drive the liquid crystal panel by a driving signal produced from a video signal extracted from the television broadcast signal to display images on a screen;

wherein the separately excited inverter circuit, comprises:

a step-up transformer having a primary winding and a secondary winding;

a smoothing circuit for outputting a smooth voltage in which ripples are removed from the DC voltage supplied by the power supply circuit;

a full bridge circuit that is coupled with the primary winding of the step-up transformer, converts the smooth voltage into an alternate current (AC) output voltage, and applies the AC output voltage to the primary winding of the step-up transformer;

a feedback circuit for outputting a voltage in which the voltage of the secondary winding of the step-up transformer is divided into a predetermined ratio as a feedback voltage;

a driving circuit for performing the switching control of each MOSFET forming the full bridge circuit according to a frequency of an input frequency signal;

a dimming control circuit that is coupled with a command signal transmission line, and outputs a frequency signal to the driving circuit when receiving a command signal from the command signal transmission line;

a terminal voltage monitoring circuit having a comparator that has a non-inverting input terminal with a predetermined comparing voltage input thereto the non-inverting input terminal;

and a thyristor circuit including a PNP-type first transistor and a NPN-type second transistor;

the microcomputer outputs a high-level voltage signal as the command signal;

the half bridge connection has the first switching element and a second switching element;

a drain of the first switching element is connected to a line of the direct current input voltage;

a source of the first switching element is connected to a switching output point;

a gate of the first switching element is connected to the driving circuit;

a drain of the second switching element is connected to the switching output point;

a source of the second switching element is grounded;

a gate of the second switching element is connected to the driving circuit;

a switching output point is connected to the primary winding of the step-up transformer;

the terminal voltage monitoring circuit is connected to the gate of the first switching element;

the terminal voltage monitoring circuit outputs a reference voltage to the thyristor when the terminal voltage of the gate of the first switching element is not greater than a predetermined voltage;

the reference voltage is a high-level voltage signal;

a base of the first transistor is connected to a collector of the second transistor and to a command signal transmission line;

an emitter of the first transistor is inputted the smoothened voltage;

a collector of the first transistor is coupled with a base of the second transistor of a resistor;

the collector of the first transistor is grounded through another resistor;

the collector of the first transistor is coupled with an anode of a Zener diode that is not broken down by the low-level voltage output by the comparator, but does break down by the high-level voltage output by the comparator; and the collector of the first transistor is coupled with the terminal voltage monitoring circuit through the Zener diode, an emitter of the second transistor is grounded, when the Zener diode is broken down by the reference voltage that is output from the terminal voltage monitoring circuit, the second transistor and the first transistor turn on, the command signal transmission line is grounded through the second transistor, the dimming control circuit stop oscillating, and the driving circuit stop controlling the full bridge circuit; and the microcomputer acquires the feedback voltage, outputs a signal for commanding the dimming control circuit to stop oscillating when the microcomputer detects that the feedback voltage is kept low for a predetermined time period and stops the output of the DC voltage of the power supply circuit.

* * * * *